US011035578B2

(12) United States Patent
Huang

(10) Patent No.: US 11,035,578 B2
(45) Date of Patent: Jun. 15, 2021

(54) REMOVABLE FIN HEAT EXCHANGER SYSTEMS AND METHODS

(71) Applicant: Johnson Controls Technology Company, Auburn Hills, MI (US)

(72) Inventor: Zhiwei Huang, Moore, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 59 days.

(21) Appl. No.: 16/290,293

(22) Filed: Mar. 1, 2019

(65) Prior Publication Data

US 2020/0271331 A1 Aug. 27, 2020

Related U.S. Application Data

(60) Provisional application No. 62/808,715, filed on Feb. 21, 2019.

(51) Int. Cl.

| | |
|---|---|
| ***F28D 1/02*** | (2006.01) |
| ***F24F 1/0067*** | (2019.01) |
| ***F24F 1/0063*** | (2019.01) |
| ***F28F 1/12*** | (2006.01) |
| ***F28F 3/02*** | (2006.01) |
| ***F28F 3/08*** | (2006.01) |
| *F24F 1/0007* | (2019.01) |
| *F25B 39/04* | (2006.01) |
| *F28F 9/02* | (2006.01) |

(52) U.S. Cl.

CPC ..... *F24F 1/0067* (2019.02); *F24F 1/0063* (2019.02); *F28F 1/126* (2013.01); *F28F 3/025* (2013.01); *F28F 3/083* (2013.01); *F24F 1/00073* (2019.02); *F24F 1/00075* (2019.02); *F25B 39/04* (2013.01); *F28F 2009/0292* (2013.01); *F28F 2215/00* (2013.01)

(58) Field of Classification Search

CPC .... F24F 1/0067; F24F 1/0063; F24F 1/00073; F24F 1/00075; F28F 1/126; F28F 3/025; F28F 3/083; F28F 2009/0292; F28F 2215/00; F25B 39/04

USPC ..... 165/152

See application file for complete search history.

(56) References Cited

U.S. PATENT DOCUMENTS

| | | | | |
|---|---|---|---|---|
| 5,529,116 | A * | 6/1996 | Sasaki | F28D 1/0417 123/41.51 |
| 5,725,047 | A * | 3/1998 | Lopez | F28D 7/08 165/149 |
| 7,966,841 | B2 * | 6/2011 | Lowenstein | F24F 3/1417 62/271 |
| 8,925,623 | B2 | 1/2015 | Sauer et al. | |

(Continued)

FOREIGN PATENT DOCUMENTS

| | | |
|---|---|---|
| CN | 101569798 | 11/2009 |
| CN | 107606823 | 1/2018 |
| WO | 2014133395 | 9/2014 |

*Primary Examiner* — Davis D Hwu

(74) *Attorney, Agent, or Firm* — Fletcher Yoder, P.C.

(57) ABSTRACT

The present disclosure relates to a fin heat exchanger, including a header, a set of tubes fluidly coupled to the header, and a mount configured to engage with and disengage from the set of tubes. The mount includes a fin section configured to extend between adjacent tubes of the set of tubes in an engaged mount configuration, and configured to be separated from the set of tubes in an unengaged mount configuration.

25 Claims, 11 Drawing Sheets

(56) References Cited

U.S. PATENT DOCUMENTS

2002/0139515 A1* 10/2002 Azar ..... F28F 3/02
165/80.3
2015/0296663 A1* 10/2015 Lin ..... H01L 23/34
165/185
2018/0195744 A1* 7/2018 Choi ..... F24F 13/30

* cited by examiner

REMOVABLE FIN HEAT EXCHANGER SYSTEMS AND METHODS

CROSS REFERENCE TO RELATED APPLICATIONS

This application claims priority from and the benefit of U.S. Provisional Application Ser. No. 62/808,715, entitled "REMOVABLE FIN HEAT EXCHANGER SYSTEMS AND METHODS," filed Feb. 21, 2019, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

Environmental control systems are utilized in residential, commercial, and industrial environments to control environmental properties, such as temperature and humidity, for occupants of the respective environments. The environmental control system may control the environmental properties through control of an air flow delivered to, and ventilated from, the environment. For example, the air flow may be directed through an air flow path of an HVAC system, where heat is exchanged between the air flow and a refrigerant flowing through the HVAC system in a heat exchanger disposed in the air flow path. In some embodiments, operation of the heat exchanger is configured to be disabled or suspended such that heat is not exchanged between the air flow and the refrigerant during certain operating modes of the HVAC system. However, the air flow may still be directed across the non-operational heat exchanger in such operating modes. It is now recognized that such traditional embodiments may decrease an efficiency of the HVAC system.

SUMMARY

The present disclosure relates to a fin heat exchanger, including a header, a set of tubes fluidly coupled to the header, and a mount configured to engage with and disengage from the set of tubes. The mount includes a fin section configured to extend between adjacent tubes of the set of tubes in an engaged mount configuration, and configured to be separated from the set of tubes in an unengaged mount configuration.

The present disclosure also relates to a heating, ventilation, and/or air conditioning (HVAC) system, including a heat exchanger having a set of tubes configured to flow a refrigerant in a first operating mode. The HVAC system further includes a mount of the heat exchanger having fins configured to extend between adjacent tubes of the set of tubes in an engaged mount configuration during the first operating mode, and configured to be separated from the set of tubes in an unengaged mount configuration during a second operating mode different than the first operating mode.

The present disclosure further relates to a heat exchanger, including a header and a set of microchannel tubes fluidly connected to and extending from the header. The heat exchanger further includes a mount having a set of plates configured to engage with the set of microchannel tubes in an engaged mount configuration, and configured to be separated from the set of microchannel tubes in a disengaged mount configuration. The heat exchanger further includes a fin section coupled to and disposed between adjacent plates of the set of plates. The fin section is configured to be disposed between adjacent microchannel tubes of the set of microchannel tubes in the engaged mount configuration and is configured to be separate from the set of microchannel tubes in the disengaged mount configuration.

DRAWINGS

DETAILED DESCRIPTION

Figure 1:
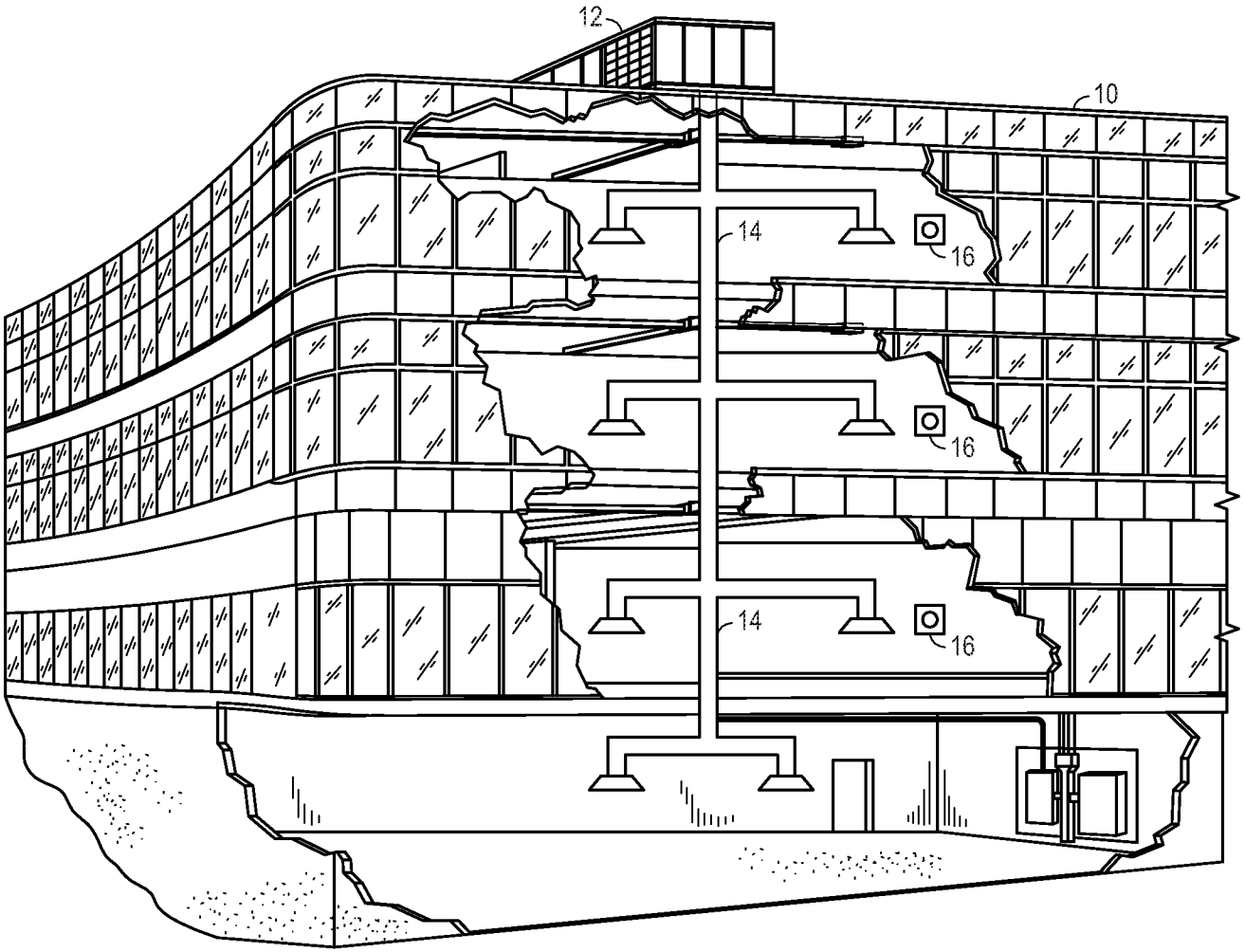
FIG. 1 is a perspective view of a heating, ventilation, and/or air conditioning (HVAC) system for building environmental management that may employ one or more HVAC units, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to heating, ventilation, and/or air conditioning (HVAC) systems that use a heat exchanger for transferring heat between a refrigerant and an air flow. In some embodiments, the heat exchanger is disposed within an air flow path such that the air flow is directed across tubes of the heat exchanger and is placed in thermal communication with a refrigerant flowing through the tubes. After heat is exchanged between the air flow and the refrigerant, the air flow may be directed to spaces to condition the spaces. As the air flow is directed through the air flow path, pressure losses, for example from friction when flowing across fins of the heat exchanger, may decrease the velocity of the air flow. Thus, the HVAC system may use an air moving device, such as a fan or blower, to increase the velocity of air flow to a desired velocity for supplying the air flow to the conditioned space.

As described above, when the heat exchanger is in heat transfer operation, refrigerant at a controlled temperature and pressure is directed through the heat exchanger and exchanges heat with the air flow as the air flow passes across the heat exchanger. Generally, the HVAC system may be configured to operate in a cooling mode and a heating mode, and a particular heat exchanger of the HVAC system may operate to transfer heat in only one of the cooling or heating modes. In some embodiments, each heat exchanger of the HVAC system may operate to condition the air flow in only one of the heating or cooling modes. For example, in one of the modes, such as the heating mode, a particular heat exchanger, such as the evaporator, may not be used to transfer heat with the air flow. In traditional embodiments, the traditional heat exchanger may remain within the air flow path when not in heat transfer operational, and the air flow may still be directed across fins of the traditional heat exchanger. As a result, the air flow may experience pressure loss when flowing across the traditional heat exchanger. For example, in a winter season when the HVAC system is in a heating mode and the traditional heat exchanger is not in heat transfer operation, the traditional heat exchanger may cause a pressure loss in an air flow passing thereover without providing any heat transfer benefits, resulting in HVAC system inefficiencies. In other embodiments, the entire traditional heat exchanger may be removed from the air flow path when not in heat transfer operation, which may involve expensive controls and/or expensive and complicated maintenance procedures.

Thus, in accordance with embodiments of the present disclosure, it is presently recognized that disengaging fins from the heat exchanger, and removing the fins from the air flow path, may improve operation of the HVAC system. In doing so, pressure loss of the air flow may be reduced or negated, compared to traditional embodiments, when the HVAC system is operating in a mode where the heat exchanger is not in heat transfer operation. That is, if the fins are removed from the heat exchanger when the heat exchanger is not in heat transfer operation, an undesired decrease in velocity of the air flow caused by the fins in traditional embodiments may be reduced or negated. As a result, the HVAC system may operate more efficiently. Specifically, the substantial removal of the fins of the heat exchanger from the air flow path when the heat exchanger is not in heat transfer operation enables the air flow to more easily flow through the heat exchanger, thereby reducing a decrease in velocity of the air flow. As a result, an air moving device of the HVAC system that increases the velocity of the air flow may operate at a lower power to increase the efficiency of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56. The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
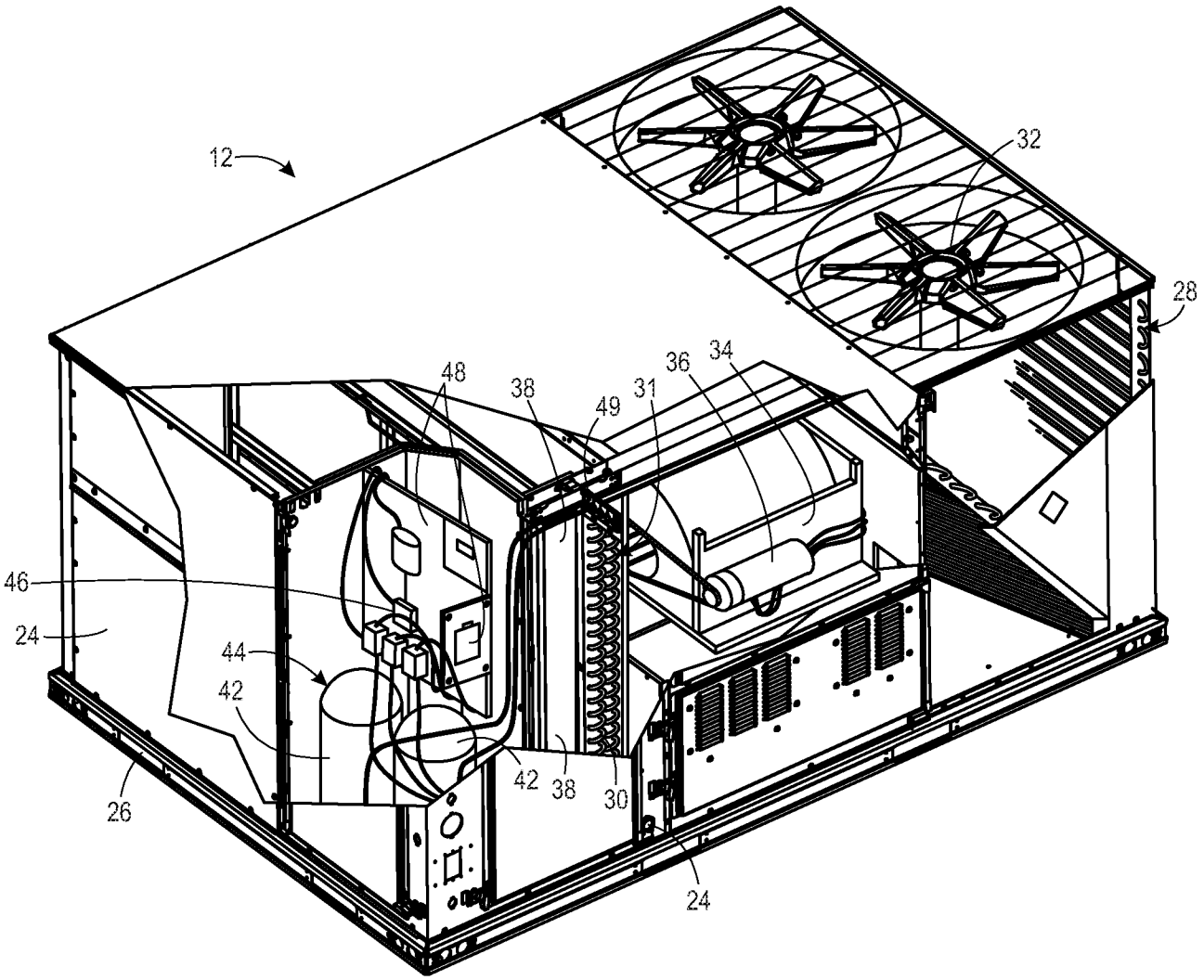
FIG. 2 is a perspective view of an HVAC unit that may be used in the HVAC system of FIG. 1, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
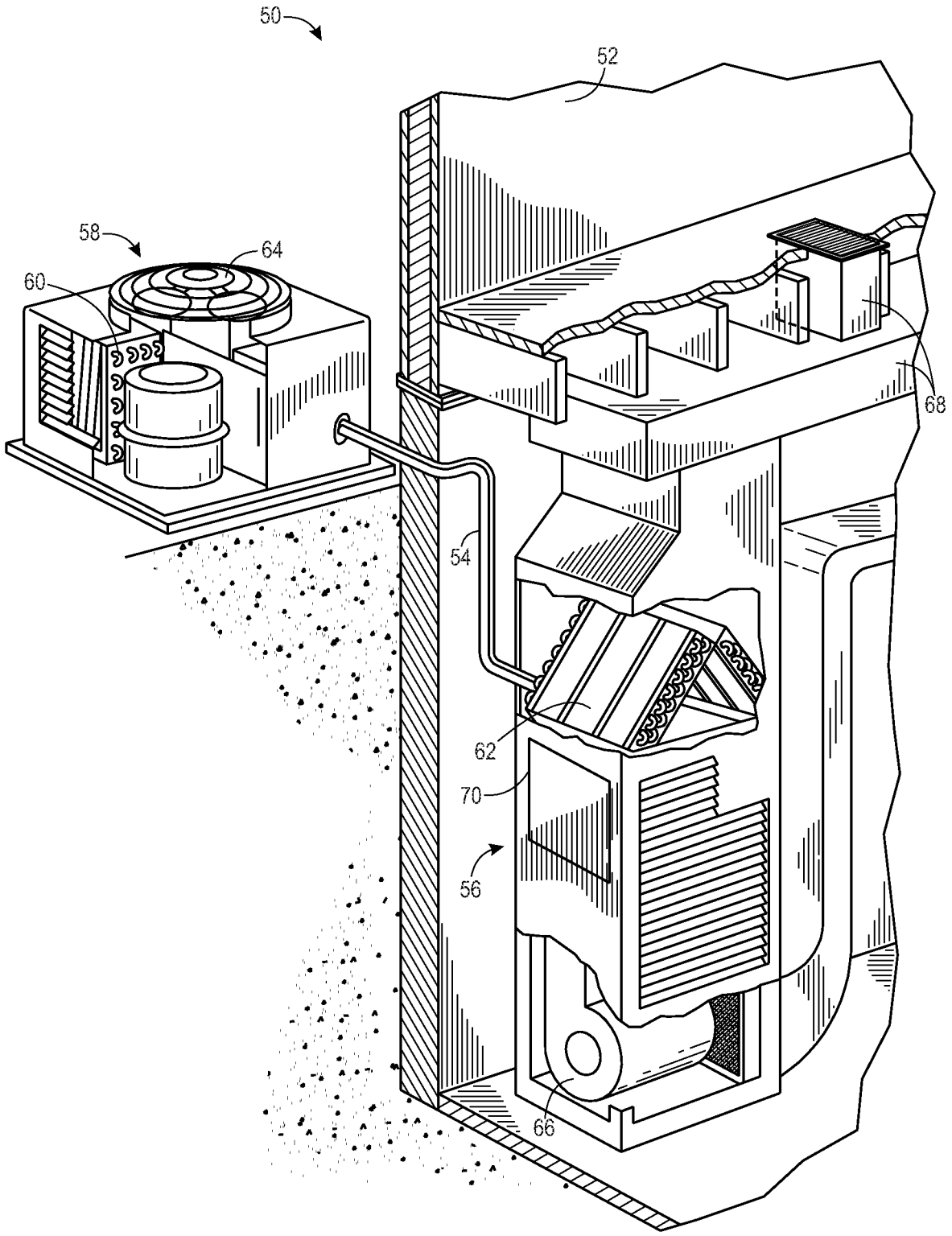
FIG. 3 is a perspective view of a residential, split heating and cooling system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
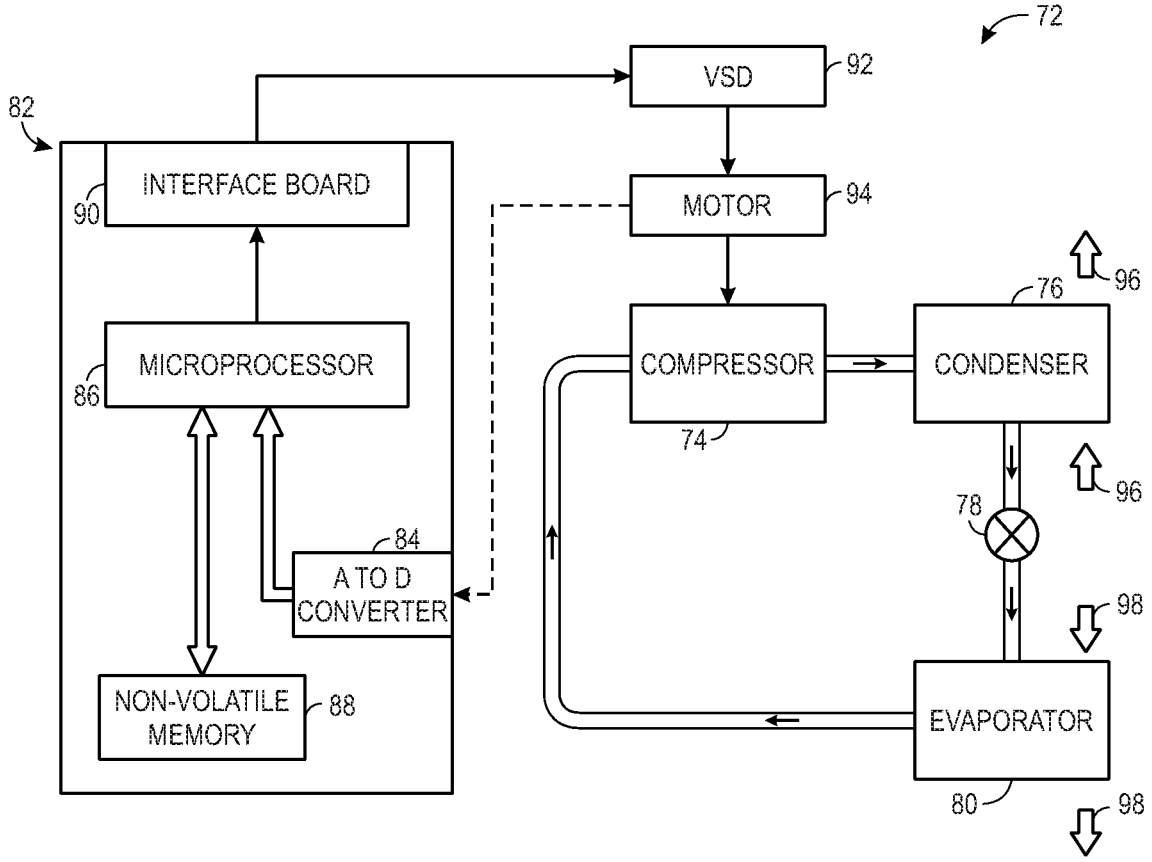
FIG. 4 is a schematic of a vapor compression system that may be used in an HVAC system, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, an HVAC system, such as the HVAC system of FIGS. 1-4, is configured to direct an air flow through an air flow path in the HVAC system. Additionally, a temperature and/or pressure controlled refrigerant may flow through a heat exchanger of the HVAC system that is disposed along the air flow path. The heat exchanger is configured to place, in certain operating modes, the air flow and the refrigerant in thermal communication with one another. For example, the heat exchanger includes tubes through which the refrigerant flows to enable heat exchange between the refrigerant and the air flow flowing across the heat exchanger. In on embodiment, the heat exchanger may be an evaporator configured to receive refrigerant and to cool the air flow passing thereover via heat exchange between the refrigerant and the air flow. A velocity of the air flow may decrease as the air flow is directed across the tubes. To increase the velocity of the air flow, in particular in operating modes in which the heat exchanger is not in heat exchange operation, the HVAC system may include a mount having fins configured to easily engage and disengage from the heat exchanger. For example, if the heat exchanger is an evaporator, the mount may be removable during a heating mode in which the evaporator is not in heat transfer operation, such that the evaporator does not substantially and unnecessarily reduce a pressure of the air flow.

Figure 5:
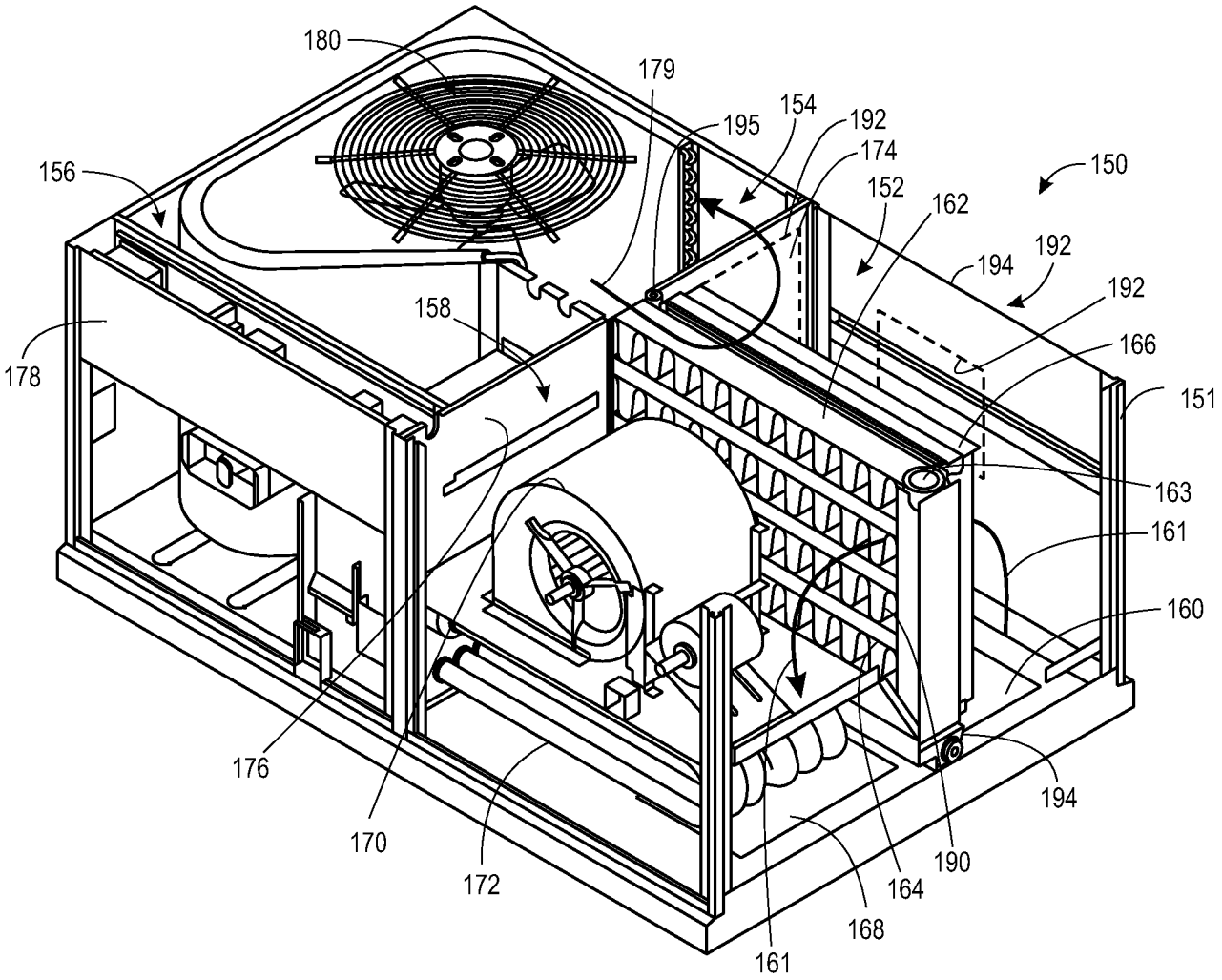
FIG. 5 is a schematic perspective view of an HVAC system having a heat exchanger base and a removable mount coupled to the heat exchanger base and having fins, in accordance with aspects of the present disclosure.

FIG. 5 is a perspective view of an embodiment of an HVAC system 150, which may be a packaged HVAC unit, having a heat exchanger with removable fins. The HVAC system 150 may include a housing 151 through which an air flow may be directed and conditioned. As illustrated in FIG. 5, the housing 151 includes a first volume 152, a second volume 154, a third volume 156, and a fourth volume 158. As will be appreciated, each volume 152, 154, 156, 158 may include a particular section within the housing 151 defined by structural members, such as panels, borders, frame members, and/or enclosures. Each volume 152, 154, 156, 158 may also include internal components of the HVAC system. In some embodiments, the internal components of different volumes 152, 154, 156, 158 are separated and/or isolated from one another. In FIG. 5, several of the structural members are substantially removed to illustrate the internal components within each of the volumes 152, 154, 156, 158.

The first volume 152 includes a return air section 160 or inlet. An air flow, such as a return air flow from a conditioned space serviced by the HVAC system 150, is configured to enter the housing 151 via the return air section 160 to begin circulation along an air flow path 161 of the HVAC system 150. The HVAC system 150 may include a first partition 174 disposed in between the first volume 152 and the second volume 154 to block the air flow from traveling between the first volume 152 and the second volume 154. Additionally, the HVAC system 150 may include a second partition 176 disposed between the third volume 156 and the fourth volume 158 to block the air flow from traveling between the third volume 156 and the fourth volume 158. The first partition 174 and the second partition 176 may contain the air flow within the air flow path 161 such that the air flow is directed from the first volume 152 to the fourth volume 158 in both the heating mode and the cooling mode.

An evaporator 162 may define a boundary between the first volume 152 and the fourth volume 158, and is configured to place the air flow in thermal communication with a refrigerant flowing through a header 163 and tubes 164 of the evaporator 162. That is, the evaporator 162 may receive refrigerant via the header 163, and may flow the refrigerant from the header 163 through the tubes 164 to exchange heat with the air flow passing over the tubes 164. In some embodiments, the header 163 may be a manifold, or any suitable conduit configured to flow liquid, such as refrigerant, as described herein. In some embodiments, the header 163 may be a refrigerant inlet and outlet of the evaporator 162. In some embodiments, the evaporator 162 may include two headers 163, with one serving as a refrigerant inlet and one serving as a refrigerant outlet. In operation, the refrigerant flowing through the tubes 164 of the evaporator 162 may remove heat from the air flow passing across the evaporator 162. As the refrigerant removes heat from the air flow, the refrigerant may be at least partially vaporized. Thus, the evaporator 162 may be in heat transfer operation during a cooling mode of the HVAC system 150, for example during a summer season. As discussed herein, the tubes 164 of the evaporator may be microchannel tubes configured to flow refrigerant through microchannels extending within the tubes 164.

The evaporator 162 is disposed within the air flow path 161, thereby enabling the air flow to be directed across the evaporator 162 after entering the first volume 152. In some embodiments, the HVAC system 150 includes a filter 166 positioned upstream of the evaporator 162 relative to the air flow path 161. The filter 166 may remove particles from the air flow, such as dirt and other debris. The filter 166 may be any suitable structure configured to remove one or more particles or components from the air flow, such as a pleated filter, an electrostatic filter, a high-efficiency particulate air (HEPA) filter, or a fiber glass filter that traps the debris when the air flow passes through the filter 166.

The evaporator 162 may at least partially separate the first volume 152 and the fourth volume 158. As such, when the air flow is directed across the evaporator 162, the air flow exits the first volume 152 and enters the fourth volume 158 of the HVAC system 150 along the air flow path 161. The fourth volume 158 may include a supply air section 168 or outlet, which may be coupled to conditioned spaces serviced by the HVAC system 150. For example, the supply air section 168 may be fluidly coupled to ducts of a building that receive the air flow exiting the HVAC system 150 via the supply section 168 and distribute the air flow to conditioned spaces within the building.

As mentioned above, the air flow may enter the HVAC system 150, such as via the return air section 160, at an initial velocity and may exit the HVAC system 150, such as via the supply air section 168, at a desired velocity. However, as the air flow is directed through the HVAC system 150, the velocity of the air flow may decrease below the desired velocity. Thus, the HVAC system 150 may include a blower 170 configured to increase the velocity of the air flow and direct the air flow to exit the supply air section 168 at the desired velocity.

In some embodiments, a heat exchanger 172 is positioned downstream of the blower 170 in the air flow path 161, and is configured to place the air flow in thermal communication with a fluid flowing through the heat exchanger 172. For example, the heat exchanger 172 may place the air flow in thermal communication with a heated fluid, such as combustion products, to add heat to the air flow to increase a temperature of the air flow exiting the supply section 168. Thus, the heat exchanger 172 may be configured to operate to heat the air flow in a heating mode of the HVAC system 150, whereas the evaporator 162 may be configured to operate to cool the air flow in a cooling mode of the HVAC system 150. Indeed, in some embodiments, while the HVAC system 150 is in the heating mode, the heat exchanger 172 may be operating, such as by placing the air flow in communication with a heated fluid, such as combustion products, and the heat exchanger 162 may not be in heat transfer operation. That is, during the heating mode, refrigerant may not be flowed through the heat exchanger 162 for heat transfer with an air flow passing over the heat exchanger 162.

In certain embodiments, a controller 178 may determine the operating mode of the HVAC system 150. For example, the controller 178 is disposed in the third volume 156 in the illustrated embodiment. The controller 178, which may be substantially similar to the control panel 82, may include a memory with stored instructions for operating the HVAC system 150, including determining the operating mode for the HVAC system 150. The controller 178 may also include a processor configured to execute such instructions. For example, the processor may include one or more application specific integrated circuits (ASICs), one or more field programmable gate arrays (FPGAs), one or more general purpose processors, or any combination thereof. Additionally, the memory may include volatile memory, such as random access memory (RAM), and/or non-volatile memory, such as read-only memory (ROM), optical drives, hard disc drives, or solid-state drives. Although FIG. 5 illustrates the controller 178 disposed in the third volume 156, in additional or alternative embodiments, the controller 178 may be disposed elsewhere in the HVAC system 150 and/or disposed externally to the HVAC system 150.

The controller 178 may determine the operating mode of the HVAC system 150 based at least in part on a desired temperature for spaces to be conditioned and serviced by the HVAC system 150. Based on the operating mode selected or determined, the controller 178 may suspend operation of certain components of the HVAC system 150 to conserve power to operate the HVAC system 150. For example, if a desired temperature of the space is greater than a current temperature of the space, the controller 178 may determine that the HVAC system 150 should operate in a heating mode. The controller 178 may be configured to make this determination based on feedback, such as temperature data of the conditioned space and/or a conditioned space temperature setpoint. In the heating mode, the controller 178 may operate the heat exchanger 172 to heat the air flow, while suspending operation of the evaporator 162 that is configured to cool the air flow. If the desired temperature of the space is less than a current temperature of the space, the controller 178 may determine that the HVAC system 150 should operate in a cooling mode. In the cooling mode, the controller 178 may operate the evaporator 162 to cool the air flow, while suspending operation of the heat exchanger 172 that is configured to heat the fluid.

Moreover, as the air flow is directed through the air flow path 161, the refrigerant may circulate through a refrigerant circuit 179 of the HVAC system 150. For example, after the refrigerant absorbs heat from the air flow in the evaporator 162, the heated refrigerant may be directed from the evaporator 162 disposed in the first volume 152 to a condenser 180 disposed in the second volume 154. The refrigerant is cooled within the condenser 180 by air, such as ambient air, flowing across the condenser 180. In some embodiments, the condenser 180 may use a fan or a group of fans to force air across the condenser 180 to remove heat from the refrigerant and reject the heat from the HVAC system 150. After being cooled in the condenser 180, the refrigerant may flow to the evaporator 162 again to continue to remove heat from the air flow, such as when the HVAC system 150 is operating in the cooling mode. As will be appreciated, the refrigerant circuit 179 may include a compressor and/or an expansion valve configured to change a pressure and/or a temperature of the refrigerant as the refrigerant is directed through the refrigerant circuit 179. Adjusting the pressure and/or temperature of the refrigerant may increase/decrease the amount of heat exchanged between the air flow and the refrigerant within the evaporator 162 and/or the amount of heat removed from the refrigerant in the condenser 180. In some embodiments, the compressor may discontinue operation, such as during the heating mode of the HVAC system 150, such that refrigerant does not flow along the refrigerant circuit 179. As will be appreciated, the HVAC system 150 may include other components operable to enable desired heat transfer to and from the air flow. In this manner, the HVAC system 150 may monitor and/or adjust characteristics or a quality of the air flow that is supplied to spaces conditioned by the HVAC system 150.

As discussed herein, the evaporator 162 may be a microchannel evaporator heat exchanger having the tubes 164, such as microchannel tubes, and the one or more headers 163 configured to flow refrigerant through the heat exchanger 162 to exchange heat with the airflow. The heat exchanger 162 may further include sections of fins 190, such as thermal fins, that extend between the tubes 164. In some embodiments, the fins 190, a section of the fins 190, a section of fin 190, a fin section, a fins section, or a fin may be defined as a single, continuous, undulating strip of material having a relatively high heat transfer coefficient that is configured to extend between adjacent tubes 164. That is, each adjacent pair of tubes 164 may include a single, continuous, undulating strip of fin, or fins 190, having a relatively high heat transfer coefficient disposed therebetween in certain configurations. The fins 190 are configured to increase a rate of heat transfer between the airflow and refrigerant flowing through the tubes 164. For example, the fins 190 may include a metal material having a relatively high heat transfer coefficient.

As discussed in further detail below, the fins 190 may be removable from the tubes 164 of the heat exchanger 162. Particularly, as shown in the illustrated embodiment, the fins 190 may include multiple sets of fins 190 that span between the tubes 164. In other words, the heat exchanger 162 may include sections or layers of fins 190 that are separated by the tubes 164. As will be appreciated, the multiple sets of fins 190 may be coupled together across the tubes 164 by a mount or connecting structure such that the multiple sets of fins 190, and corresponding mount or connecting structure, may be repositioned through manipulation of a single, substantially rigid structure. Once removed from the tubes 164, the fins 190 may be mounted to one or more mounting locations 192 within or external to the HVAC system 150. That is, the mounting location 192 may be disposed on a housing element of the housing 151.

For example, in some embodiments, the mounting location 192 may be located external to the HVAC system 150 on an external wall 194 of the HVAC system 150. In some embodiments, the mounting location 192 may be located internal to the HVAC system on the external wall 194, such as within the first volume 152. In some embodiments, the mounting location 192 may located on the first partition 174 within the first volume 152. In some embodiments, the mounting location 192 may be located on a top wall, such as a roof, of the HVAC system 100. It should be noted that the illustration of the top wall in the currently illustrated embodiment has been omitted to highlight features of the internal components of the HVAC system 100. In some embodiments, the mounting location 192 may be located at any suitable location within or adjacent to the HVAC system 150 that provides easy and simple transference of the fins 190 from the currently illustrated position of the evaporator 162 to the mounting location 192. Further, the mounting location 192 may include mounting elements, such as tabs, latches, mounts, ledges, or any other suitable structure configured to receive and support the fins 190.

In some embodiments, the fins 190 may be coupled to a transfer mechanism 194 configured to transfer the fins 190 from the heat exchanger 162 to the mounting location 192. The transfer mechanism 194 may include, for example, a motor or actuator communicatively coupled to the controller 178. The controller 178 may send a transfer signal to the transfer mechanism 194. Based on receipt of the transfer signal, the transfer mechanism 194 is configured to transfer the fins 190 to the mounting location 192 from the heat exchanger 162 or to the heat exchanger 162 from the mounting location 192. In some embodiments, the controller 178 may send the transfer signal to adjust the position of the fins 190 depending on the operating mode of the HVAC system 150. In some embodiments, the transfer mechanism 194 may include a manually actuated device, which may include pneumatic elements, for example. In such embodiments, the transfer mechanism 194 may be manually manipulated by a user or technician to move the fins 190 from the heat exchanger 162 to the mounting location 192. In some embodiments, the transfer mechanism 194 may include a hinge 195. That is, the fins 190 may be coupled to the hinge 195 and may be configured to rotate about the hinge 195 to transition to the mounting location 192.

Figure 6:
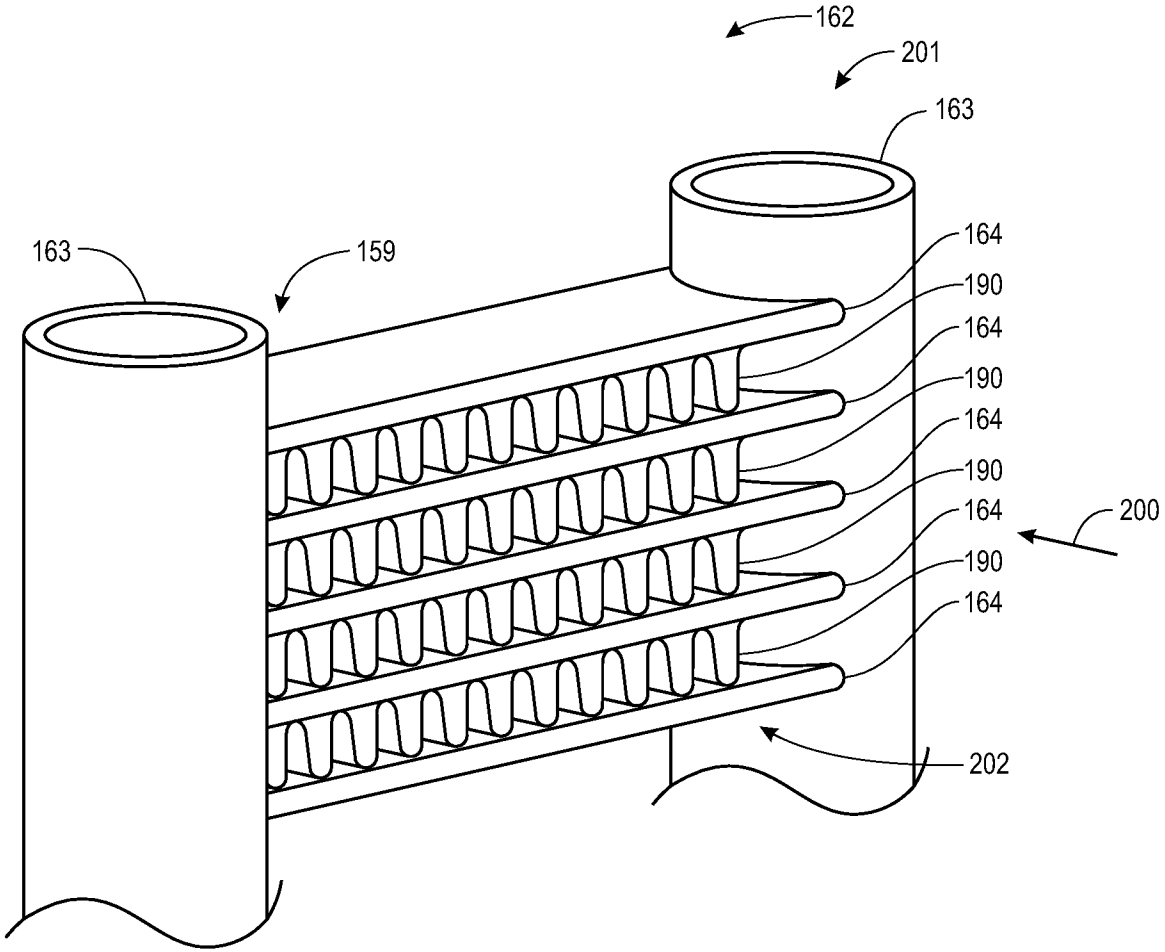
FIG. 6 is a schematic perspective view of the heat exchanger base and the removable mount of FIG. 5 in an engaged mount configuration, in accordance with aspects of the present disclosure.

Keeping the description above in mind, FIG. 6 is a perspective view of the evaporator microchannel heat exchanger 162 having the removable fins 190. As mentioned above, the heat exchanger 162 may further include the one or more headers 163 and the tubes 164, which may be referred to as a base 159 of the heat exchanger 162. Generally, the headers 163 may serve as inlets and/or outlets for the refrigerant flowing through the heat exchanger 162 along the refrigerant circuit 179, as seen in FIG. 5. Particularly, the headers 163 may route the refrigerant through microchannels extending through the tubes 164. At the same time, an air flow 200 may be moved across the fins 190 of the heat exchanger 162. Accordingly, the air flow 200 and the refrigerant may be placed in a heat exchange relationship, as discussed above.

As shown in the illustrated embodiment, the fins 190 may be disposed between the tubes 164, such that sections of fins 190 are separated by the tubes 164. In other words, the tubes 164 may be disposed between separate sections or layers of the fins 190. As discussed herein, the separate sections of the fins 190 may be coupled together via plates of a mount 202. That is, the mount 202 may include the fins 190 and the plates. In the currently illustrated embodiment of FIG. 6, the mount 202 is in an engaged mount configuration 201, meaning that the mount 202 is engaged with the tubes 164 and/or the header 163 of the heat exchanger 162. Indeed, the sections of fins 190, or fin sections, may extend between the tubes 164 while the mount 202 is in the engaged mount configuration 201. As discussed herein, the extension of the sections of fins 190 between the tubes 164 may be defined as the sections of the fins 190 directly contacting adjacent tubes 164 and/or indirectly contacting adjacent tubes 164 with a material, such as metal plates, disposed at interfaces between the adjacent tubes 164 and the sections of the fins 190. While in the engaged mount configuration 201, the fins 190 may be within the air flow path 161. While the mount 202 is in the engaged mount configuration 201, the fins 190 may enhance heat exchange, but may cause a pressure drop, or a decrease in velocity, of the air flow 200 as the air flow 200 moves across the fins 190 along the air flow path 161.

Further, in some embodiments, the mount 202 may be in a disengaged mount configuration, such as when the mount 202 is separate or disengaged from the tubes 164 and/or the header 163 of the heat exchanger 162. As discussed above, the mount 202 may be moved to the mounting location 192, as seen in FIG. 5, while in the disengaged mount configuration.

Figure 7:
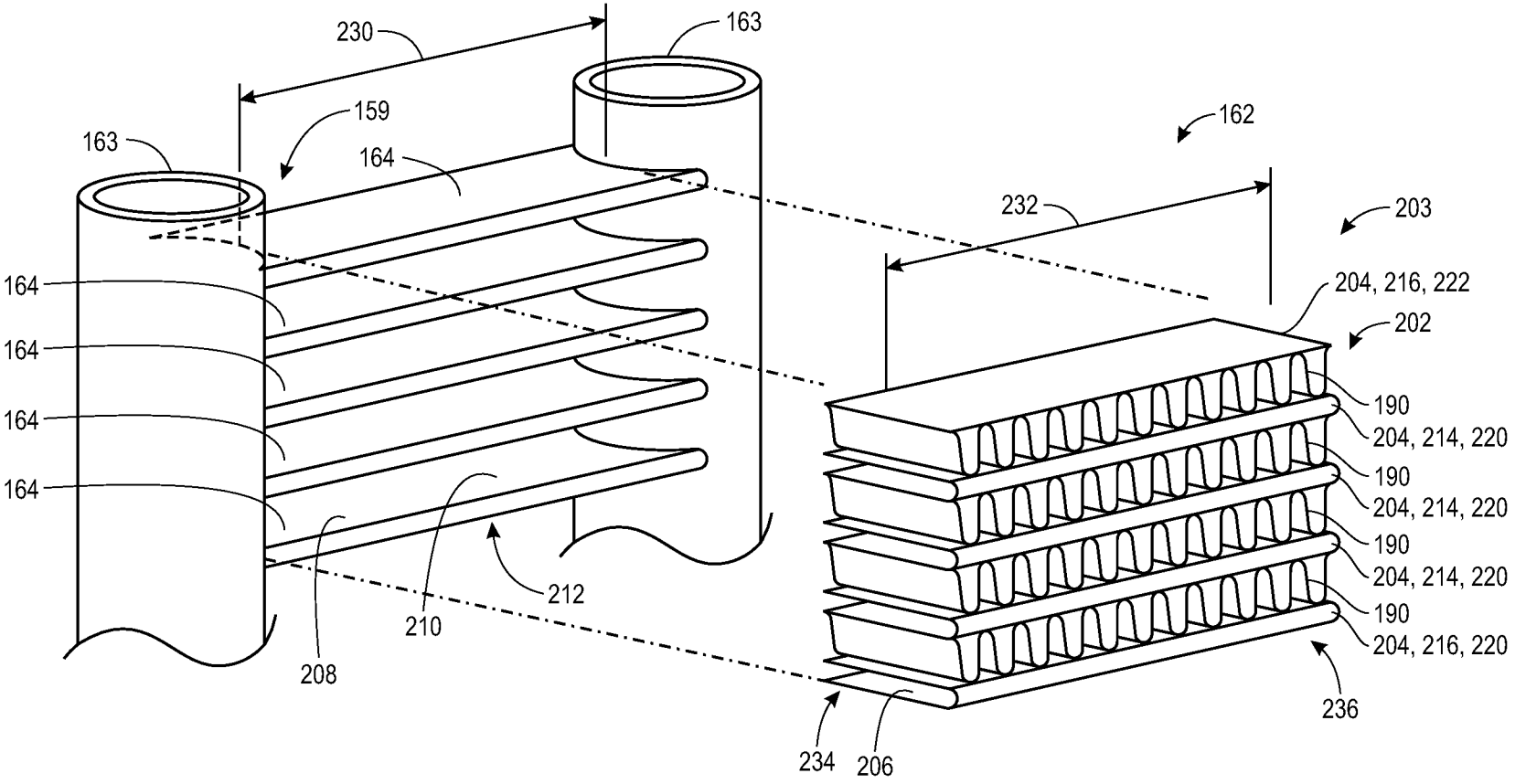
FIG. 7 is a schematic perspective view of the heat exchanger base and the removable mount of FIG. 5 in a disengaged mount configuration, in accordance with aspects of the present disclosure.

FIG. 7 is a perspective view of the heat exchanger 162 having the mount 202 in a disengaged mount configuration 203, such as disengaged from the heat exchanger base 159 formed by the tubes 164 and/or the header 163. Indeed, the mount 202 may be defined as a structure configured to facilitate ready attachment to, and removal from, the base 159. Indeed, the mount 202 may be coupled to, and decoupled from, the base 159 in a toolless manner. That is, the mount 202 may be transitioned between the engaged mount configuration 201 (FIG. 6) and the disengaged mount configuration 202 without the use of tools, such as screw drivers, hammers, saws, welding equipment, and so forth. The mount 202 includes the fins 190 and a set of plates 204. The fins 190 are coupled directly to the set of plates 204, as shown. In some embodiments, the fins 190 may be welded or coupled in any other suitable manner to the plates 204. The plates 204 may be formed from metal, such as pieces of sheet metal. In some embodiments, the fins 190 and the plates 204 may be formed of the same material. In this way, the plates 204 may be considered extensions of the fins 190, or a part of the fins 190. As such, the fins 190 may directly contact the tubes 164.

The mount 202 is configured to engage with and disengage from the tubes 164 of the heat exchanger 162. More specifically, in the illustrated embodiment, the plates 204 of the mount 202 are configured to engage with the tubes 164. Indeed, as shown, a contour of an inner surface 206 of the plates 204 may substantially match a contour of an outer surface 208 of the tubes 164. For example, in the currently illustrated embodiment, a top surface 210 and a bottom surface 212 of the outer surface 208 of the tubes 164 may be substantially flat, and the inner surface 206 of the plates may similarly include substantially flat portions. Further, as will be appreciated, in some embodiments, the top surface 210 and the bottom surface 212 of the tubes 164 may extend substantially parallel to each other, and the inner surface 206 of the plates 204 may similarly include portions that similarly extend substantially parallel to each other. Indeed, the substantially corresponding contours of the inner surface 206 of the plates 204 and the outer surface 208 of the tubes 164 may cause increased surface-to-surface contact between the plates 204 and the tubes 164, which enhances conductive heat transfer between the fins 190 and the tubes 164.

In the illustrated embodiment, the base 159 of the heat exchanger 162 includes five tubes 164, and the mount 202 includes five plates 204. However, it is to be understood that the base 159 of the heat exchanger 162 may include any suitable number of tubes 164, and the mount 202 may include a corresponding suitable number of plates 204. The mount 202 may include interior plates 214 and exterior plates 216. Particularly, the mount 202 may include two exterior plates 216 and any suitable number of interior plates 214 disposed between the two exterior plates 216. For example, in the currently illustrated embodiment, the mount 202 includes three interior plates 214. The interior plates 214 may each be whole plates 220. The whole plates 220 may be defined as plates 204 having the inner surface 206 configured to engage with both the top surface 210 and the bottom surface 212, or a majority, of the outer surface 208 of the tubes 164. In some embodiments, each of the whole plates 220 may be C-shaped to match or correspond to the contour of the outer surface of the tubes 164. In some embodiments, the plates 204 may be flexible, such that the plates 204 may apply a pressure to the tubes 164 when coupled to the base 159. Indeed, in such embodiments, the C-shaped formation of the plates 204 may be configured to bend or elastically deform, similar to mechanics of a money clip, in order to couple to the tubes 164.

Further, the exterior plates 216 may be whole plates 220 and/or partial plates 222. For example, as shown in the currently illustrated embodiment, the exterior plates 216 include one whole plate 220 and one partial plate 222. That is, the upper exterior plate 216 is a partial plate 222 and the lower exterior plate 216 is a whole plate 220. Partial plates 222 may be defined as plates 204 configured to contact only half or less than half of the outer surface 208 of the tubes 164. For example, as shown, the partial plate 222 may include a substantially flat piece of material, such as sheet metal, which may be configured to contact one of either the top surface 210 or the bottom surface 212 of a respective tube 164.

The tubes 164 may include a tube length 230. The tube length 230 may be defined by a distance that the tube 164 spans between the headers 163 in the illustrated embodiment. Similarly, the plates 204 of the mount 202 may include a plate length 232. Particularly, the plate length 230 may be defined by a distance that each plate 204 spans between a first side 234 of the mount 202 and a second side 236 of the mount 202. The fins 190 may similarly extend the plate length 230 along the plates 204. The tube length 230 and the plate length 232 may be substantially equal. In this manner, the fins 190 may span along substantially the entirety of the tubes 164 to promote heat transfer in the engaged configuration.

Keeping this in mind, FIGS. 8-11 are perspective views of embodiments of an end 241 of one of the plates 204 of the mount 202. That is, the end 241 may be disposed at the first side 234 or the second side 236 of the mount 202. Each of the plates 204 shown in FIGS. 8-11 may be illustrated as whole plates 220, as discussed above with respect to FIG. 7. However, it is to be understood that features of the embodiments discussed in reference to FIGS. 8-11 may also be included in the partial plates 222 of the mount 202 illustrated in FIG. 7.

Figure 8:
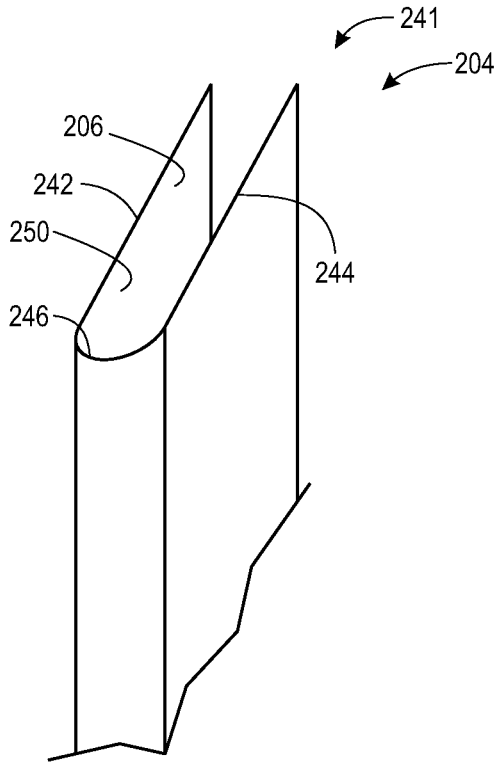
FIG. 8 is a schematic perspective view of a plate of the removable mount of FIG. 5, in accordance with aspects of the present disclosure.

As shown in FIG. 8, the plate 204 may include a first side portion 242, a second side portion 244, and a connecting portion 246. The first side portion 242 and the second side portion 244 may both extend substantially parallel to each other from edges of the connecting portion 246. That is, the first side portion 244 and the second side portion 246 may both be substantially flat and maintain a substantially constant spacing between each other. However, as mentioned above, the shape of the plate 204 may substantially match or correspond to the shape of the tubes 164. Thus, it should be understood that the shape of the first side portion 244 and the second side portion 246 may be based on the shape of the tubes 164 and may not necessarily be substantially flat and/or parallel in some embodiments. The connecting portion 246 may be curved to match or correspond to a curvature of the tubes 164. The curved surface of the connecting portion 246 may be positioned to face against the direction of the air flow path, such that connecting portion 246 aerodynamically distributes the air flow across the fins 190. The first portion 242, the second portion 244, and the connecting portion 246 collectively define a C-shaped configuration of the plate 204.

In some embodiments, the inner surface 206 of the plate 204 may include a heat transfer promotion layer 250. The heat transfer promotion layer 250 is configured to contact the tubes 164 to promote heat transfer between the plates 204 and the tubes 164 in the engaged mount configuration 201. The heat transfer promotion layer 250 may include a thermal interface compound, such as thermal paste, thermal grease, a thermal pad, or other suitable material configured to promote heat transfer.

Figure 9:
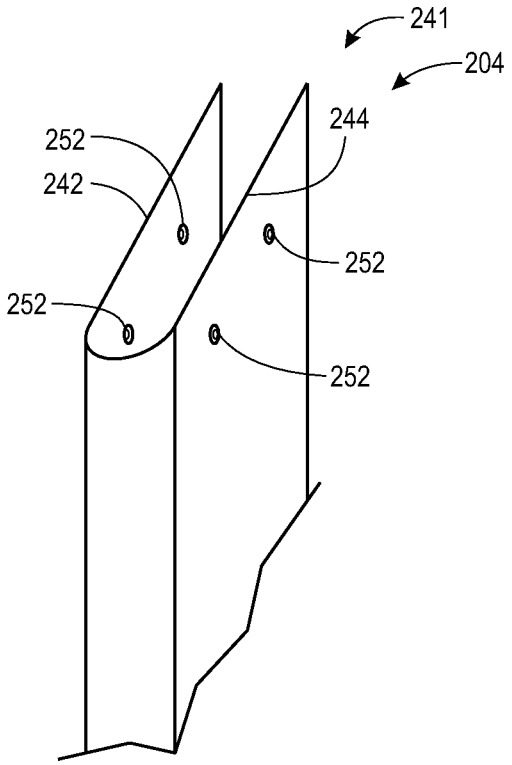
FIG. 9 is a schematic perspective view of a plate of the removable mount of FIG. 5, in accordance with aspects of the present disclosure.

In some embodiments, as shown in FIG. 9, the plates 204 may include a coupling component 252 configured to couple to a corresponding component of the tubes 164. For example, in some embodiments, the coupling component 252 may include one or more concavities, or dimples, configured to engage with one or more convexities, or protrusions, of the tubes 164. Conversely, in some embodiments, the coupling component 252 may include one or more convexities, or protrusions, configured to engage with one or more concavities, or dimples, of the tubes 164. In the currently illustrate embodiment, the end 241 of the plate 204 may include two coupling components 252 on each of the first side portion 242 and the second side portion 244. However, it is to be understood that the plate 204 may include any suitable number of coupling components 252 disposed at any suitable positions along the plate 204. In some embodiments, the coupling components 252 may include beads, latches, notches, snap-fits joints, clips, protrusions, or any other suitable element configured to cause the mount 202 and the headers 163 and/or tubes 164 to couple to each other in the engaged mount configuration 201.

Figure 10:
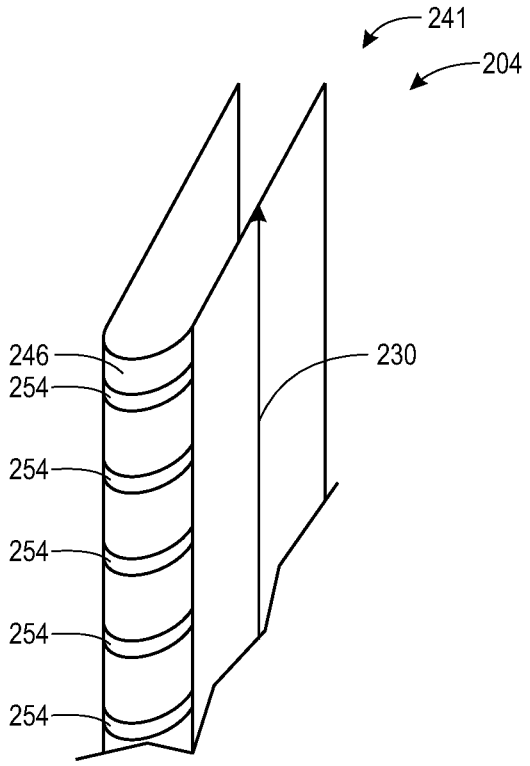
FIG. 10 is a schematic perspective view of a plate of the removable mount of FIG. 5, in accordance with aspects of the present disclosure.

In some embodiments, as shown in FIG. 10, the connecting portion 246 of the plate 204 may include one or more gaps or apertures 254 disposed along the plate length 230. That is, the connecting portion 246 may include sections of material with the apertures 254 disposed between the sections of material. The apertures 254 disposed along the connecting portion 246 allow for a portion of the air flow moving along the air flow path 161 to directly contact portions the tubes 164 disposed within the plates 204 to increase heat transfer. Manufacturing the plates 204 with the apertures 254 may also reduce material costs.

Figure 11:
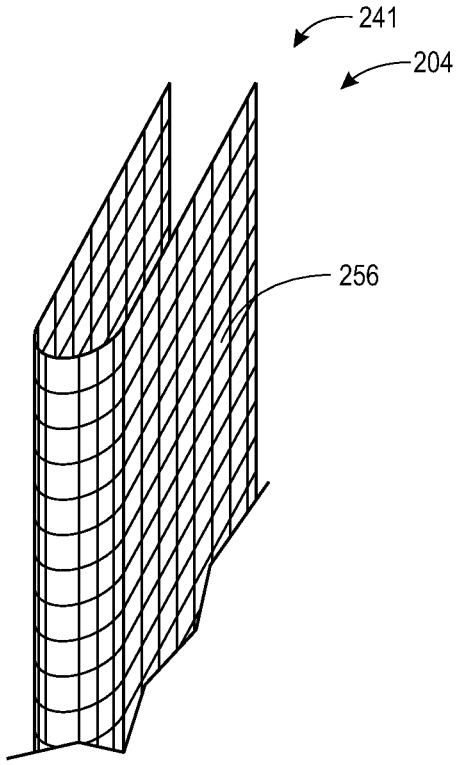
FIG. 11 is a schematic perspective view of a plate of the removable mount of FIG. 5, in accordance with aspects of the present disclosure.

Further, in some embodiments, as shown in FIG. 11, the plate 204 may be formed of a mesh structure 256, such as a woven metal material. The mesh structure 256 may be air permeable such that the air flow moving along the air flow path 161 may directly contact portions of the tubes 164 disposed within the plates 204 to increase heat transfer. Further, manufacturing the plates 204 with the mesh structure 256 may reduce material costs.

Figure 12:
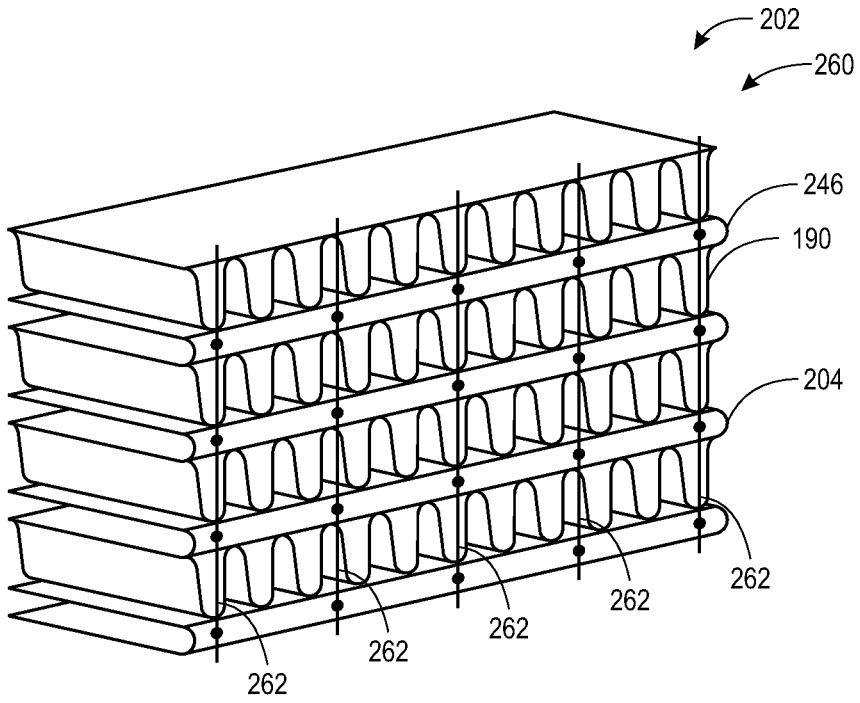
FIG. 12 is a schematic perspective view of the removable mount of FIG. 5, in accordance with aspects of the present disclosure.

FIG. 12 is a perspective view of an embodiment of the mount 202 having a support structure 260 coupled to the plates 204. The support structure 260 is configured to provide support and rigidity to the mount 202. For example, the support structure 260 may include one or more rods 262 coupled to the plates 204. In the currently illustrated embodiment, the support structure 260 includes five rods 262 coupled directly to a portion or all of the plates 204. However, the support structure 260 may include any suitable number of rods 262 coupled to the plates 204. In some embodiments, the rods 262 may be welded, brazed, or coupled in any suitable manner to the plates 204. Specifically, as shown, the rods 262 are coupled to the connecting portion 246 of the plates 204. In some embodiments, the rods 262 may be additionally or alternatively coupled to the fins 190.

Figure 13:
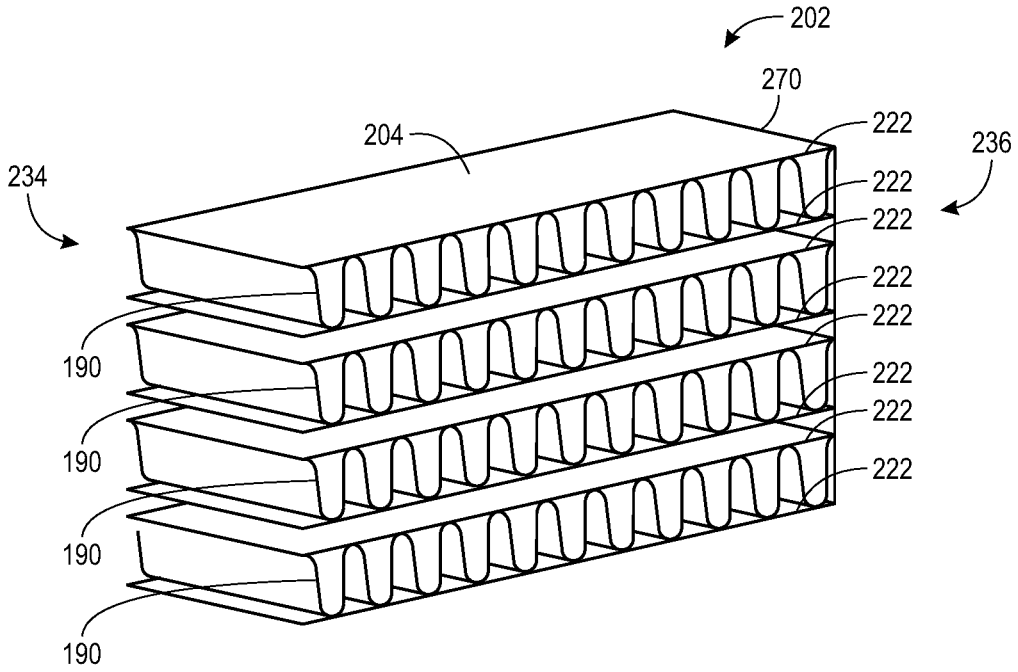
FIG. 13 is a schematic perspective view of the removable mount of FIG. 5, in accordance with aspects of the present disclosure.

FIG. 13 is a perspective schematic view of the mount 202 having one or more brackets 270 coupled to each of the sections of fins 190. In the currently illustrated embodiments, the sections of fins 190 may be coupled to the plates 204. That is, respective sections of fins 190 may be coupled to pairs of the partial plates 222, which are further coupled to the bracket 270. However, in some embodiments, each section of fins 190 may be disposed between whole plates 220, with the connecting portion 246 of the whole plates 220 directly coupled to the bracket 270.

The currently illustrated embodiment of the mount 202 may be utilized in an embodiment of the heat exchanger 162 having only one header 163. Indeed, the mount 202 may be coupled to the heat exchanger 162 such that the bracket 270 is disposed on an opposite side of the header 163. In other words, the first side 234 of the mount 270 may be disposed adjacent to the header 163 at a first end of the tubes 164 and the second side 236 of the mount 270, which includes the bracket 270, may be disposed opposite to the header 163 at a second end of the tubes 164.

Figure 14:
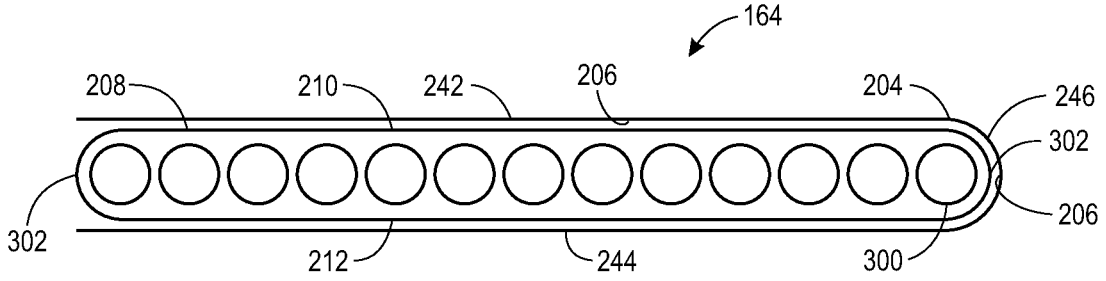
FIG. 14 is a cross-sectional view of a microchannel tube of the heat exchanger base of FIG. 5, in accordance with aspects of the present disclosure.

FIG. 14 is a cross-sectional schematic view of an embodiment of one the tubes 164 of the heat exchanger 162 having microchannels 300 disposed therethrough. In the illustrated embodiment, the tube 164 is coupled to one of the plates 204. Further, in the illustrated embodiment, a space or gap is shown as disposed between the tube 164 and the plate 204. However, the schematic illustrations of FIG. 14 are simplified for clarity of certain aspects, and it should be understood that that there may not actually be a space or gap disposed between the tube 164 and the plate 204 in some embodiments. That is, as mentioned above, the plates 204 and the tubes 164 may include a substantially flush interface.

As mentioned above, the microchannels 300 are configured to extend within the tube 164 along a length of the tube 164. Further, as discussed above, the tube 164 includes the outer surface 208 configured to engage with the inner surface 206 of the plates 204. Particularly, the outer surface 208 of the tube 164 includes the top surface 210 and the bottom surface 212, which may be substantially flat and parallel relative to each other. The top surface 210 and the bottom surface 212 may be substantially matching in shape to the first and second side portions 242, 244 of the plate 204. The tube 164 further includes edge surfaces 302. The edge surfaces 302 may be substantially matching in shape or contour to the inner surface 206 of the connecting portion 246 of the plate 204. For example, the edge surface 302 may be rounded to substantially match the C-shape provided by the connecting portion 246 of the plate 204.

The present disclosure is directed to a heat exchanger of an HVAC system having removable fins. For example, the HVAC system may be configured to move an air flow along an air flow path. The heat exchanger is disposed within the air flow path. In a first operating mode of the HVAC system, the fins of the heat exchanger may be utilized to exchange heat between the air flow and a refrigerant flowing through the heat exchanger. However, in a second operating mode of the HVAC system, the heat exchanger may not be utilized. Accordingly, to reduce pressure drops and increase velocity of the air flow moving along the air flow path in the second operating mode, the fins may be removed from the heat exchanger.

The fins may be coupled to a mount. The mount is configured to be engaged with the heat exchanger in an engaged mount configuration such that the fins are disposed between tubes of the heat exchanger. The mount is also configured to be disengaged from the heat exchanger in a disengaged mount configuration such that the fins are separate from the tubes of the heat exchanger. In this manner, the fins may easily be removed from the heat exchanger to decrease pressure losses and increase velocity of the air flow moving along the air flow path.

While only certain features and embodiments of the present disclosure have been illustrated and described, many modifications and changes may occur to those skilled in the art, such as variations in sizes, dimensions, structures, shapes and proportions of the various elements, values of parameters, such as temperatures or pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fin heat exchanger, comprising:

a header;

a plurality of tubes fluidly coupled to the header; and a mount configured to engage with and disengage from the plurality of tubes, wherein the mount includes a fin section configured to extend between adjacent tubes of the plurality of tubes in an engaged mount configuration, and configured to be separated from the plurality of tubes in an unengaged mount configuration.

2. The fin heat exchanger of claim 1, wherein the mount includes a first plate configured to engage with a first tube of the adjacent tubes in the engaged mount configuration, a second plate configured to engage with a second tube of the adjacent tubes in the engaged mount configuration, and a fin of the fin section is coupled to the first plate and to the second plate.

3. The fin heat exchanger of claim 2, wherein the first plate includes a C-shape corresponding in shape to an outer surface of the first tube, and the second plate includes a second C-shape corresponding in shape to an outer surface of the second tube.

4. The fin heat exchanger of claim 3, wherein the mount includes a third plate that is a substantially flat piece of sheet metal, wherein the fin section is a first fin section, and wherein the mount includes a second fin section configured to extend between the second plate and the third plate.

5. The fin heat exchanger of claim 2, wherein the first plate includes a first coupling component, wherein a tube of the plurality of tubes includes a second coupling component, and wherein the first coupling component is configured to engage with the second coupling component in the engaged mount configuration.

6. The fin heat exchanger of claim 5, wherein the first coupling component of the first plate is one of either a concavity or convexity, and wherein the second coupling component of the tube is a different one of either the concavity or convexity.

7. The fin heat exchanger of claim 2, wherein the first plate includes a layer having a thermal interface compound disposed on an internal surface of the first plate, and wherein the layer is configured to be disposed between the internal surface of the plate and the tube in the engaged mount configuration.

8. The fin heat exchanger of claim 1, wherein the mount includes a plurality of fin sections and at least one bracket coupled to each fin section of the plurality of fin sections.

9. The fin heat exchanger of claim 1, wherein the plurality of tubes includes a plurality of microchannel tubes.

10. The fin heat exchanger of claim 1, wherein the mount includes a plurality of plates having a mesh structure, and wherein the fin section extends between adjacent plates of the plurality of plates.

11. The fin heat exchanger of claim 1, wherein the mount includes a plurality of plates, wherein the fin section extends between adjacent plates of the plurality of plates, and wherein the mount includes a rod coupled to each plate of the plurality of plates.

12. A heating, ventilation, and/or air conditioning (HVAC) system, comprising:

a heat exchanger having a plurality of tubes configured to flow a refrigerant in a first operating mode; and a mount of the heat exchanger having fins configured to extend between adjacent tubes of the plurality of tubes in an engaged mount configuration during the first operating mode, and configured to be separated from the plurality of tubes in an unengaged mount configuration during a second operating mode different than the first operating mode.

13. The HVAC system of claim 12, wherein the mount includes a plurality of plates configured to couple to the tubes in the engaged mount configuration, and wherein the fins are coupled to and extend between adjacent plates of the plurality of plates.

14. The HVAC system of claim 13, wherein a first contour of an inner surface of a plate of the plurality of plates substantially corresponds to a second contour of an outer surface of a tube of the plurality of tubes.

15. The HVAC system of claim 12, including a mounting location disposed on a housing element of the HVAC system and separate from the plurality of tubes, wherein the mounting location is configured to receive the mount in the unengaged mount configuration.

16. The HVAC system of claim 15, including a transfer mechanism configured to transfer the mount from the plurality of tubes in the engaged mount configuration to the mounting location in the unengaged mount configuration.

17. The HVAC system of claim 16, wherein the transfer mechanism is configured to receive a transfer signal from a controller and configured to transfer the mount from the plurality of tubes to the mounting location based on receipt of the transfer signal.

18. The HVAC system of claim 12, wherein each tube of the plurality of tubes includes a plurality of microchannels configured to flow the refrigerant.

19. The HVAC system of claim 12, where a plate of the plurality of plates includes a C-shaped structure.

20. The HVAC system of claim 19, wherein the C-shaped structure includes a first side portion, a second side portion, and a connecting portion, and wherein the first side portion and the second side portion extend substantially parallel to each other from edges of the connecting portion.

21. The HVAC system of claim 20, wherein the connecting portion includes a plurality of apertures disposed along a length of the connecting portion.

22. A heat exchanger, comprising:

a header;

a plurality of microchannel tubes fluidly connected to and extending from the header;

a mount having a plurality of plates configured to engage with the plurality of microchannel tubes in an engaged mount configuration, and configured to be separated from the plurality of microchannel tubes in a disengaged mount configuration; and a fin section coupled to and disposed between adjacent plates of the plurality of plates, wherein the fin section is configured to be disposed between adjacent microchannel tubes of the plurality of microchannel tubes in the engaged mount configuration and is configured to be separate from the plurality of microchannel tubes in the disengaged mount configuration.

23. The heat exchanger of claim 22, wherein an outer surface of a microchannel tube of the plurality of microchannel tubes includes a top surface and a bottom surface that extend substantially parallel to each other.

24. The heat exchanger of claim 23, wherein a plate of the plurality of plates includes a C-shape configuration having a first side portion and a second side portion that extend substantially parallel to each other, and wherein the first side portion and the second side portion of the plate are configured to contact the top surface and the bottom surface, respectively, of the microchannel tube.

25. The heat exchanger of claim 22, wherein the mount is configured to be toollessly transitioned between the engaged mount configuration and the disengaged mount configuration.

* * * * *